US007901158B2

(12) United States Patent
Lin

(10) Patent No.: US 7,901,158 B2
(45) Date of Patent: Mar. 8, 2011

(54) UNDERWATER OIL STORAGE METHOD AND SYSTEM

(76) Inventor: Zuei-Ling Lin, Taipei (TW)

( * ) Notice: Subject to any disclaimer, the term of this patent is extended or adjusted under 35 U.S.C. 154(b) by 32 days.

(21) Appl. No.: 12/314,863

(22) Filed: Dec. 18, 2008

(65) Prior Publication Data

US 2009/0154997 A1 Jun. 18, 2009

Related U.S. Application Data

(62) Division of application No. 11/221,739, filed on Sep. 9, 2005, now abandoned.

(51) Int. Cl.
*B65G 5/00* (2006.01)

(52) U.S. Cl. ..... 405/59; 405/53

(58) Field of Classification Search ..... 405/52, 405/53, 55, 59

See application file for complete search history.

(56) References Cited

U.S. PATENT DOCUMENTS 703,824 A * 7/1902 Quinn ..... 417/317
2,880,593 A * 4/1959 Johnson et al. ..... 62/50.1
2,963,873 A * 12/1960 Stowers ..... 62/53.2

* cited by examiner

*Primary Examiner* — Sunil Singh
(74) *Attorney, Agent, or Firm* — Rosenberg, Klein & Lee

(57) ABSTRACT

An underwater oil storage method, which includes the steps of: a) excavating a cellar in the ground earth and constructing a wall structure in the cellar to form a water pool, b) setting an oil tank in the water pool, c) supplying a predetermined amount of water to the water pool, and d) filling the oil to be stored into the oil tank and regulating the amount of water in the water pool subject to the amount of storage oil stored in the oil tank for enabling water in the water pool to support the oil tank and storage oil in the oil tank and to keep the oil tank in balance by means of the physical characteristic that the specific gravity of the storage oil is lower than water.

6 Claims, 6 Drawing Sheets

UNDERWATER OIL STORAGE METHOD AND SYSTEM

RELATED APPLICATIONS

This application is a Divisional patent application of application Ser. No. 11/221,739, filed on 9 Sep. 2005, now abandoned.

BACKGROUND OF THE INVENTION

1. Field of the Invention

The present invention relates to an oil storage method and more particularly, to an underwater oil storage method, which keeps the oil tank under the water in a water pool so that the water in the water pool supports the pressure of the oil tank and isolates storage oil from the ground earth by means of the physical characteristic that the specific gravity of oil is lower than water.

2. Description of the Related Art

An oil storage tank may be mounted above or under the ground. When building an oil tank above the ground, a strong floor construction must be built up on the ground. The floor construction must be strong enough to support the heavy cylindrical or spherical steel shell of the oil tank and the oil stored in the oil tank. A conventional oil tank uses a steel shell to bear the pressure of the oil stored therein. The capacity has a limitation. Further, increasing the capacity of an oil tank will relatively increase the cost. For safety's sake, a retaining wall must be built around the oil tank(s) such that when oil leaks out of the oil tank(s), leaked oil can still be kept within the retaining wall to prevent contamination or any possible catastrophe. At present time, the capacity of Formosa Petrochemical Corp.'s oil tank is 130,000 square meters (the largest oil tank in Asia Pacific area. This oil tank has a diameter about 86 meters and a height about 24 meters. The steel shell of the oil tank must strong enough to bear the pressure of 24M-depth storage oil and to provide a damping resistance against earthquake grade 6. It took about 2 years to finish the construction of the oil tank after finish of the ground construction. The total cost for this oil tank is about two hundred millions NT dollars. Because this oil tank is exposed to the weather, it must be regularly maintained to remove rust and regularly painted. In case of a leakage of oil, the storage oil must be fully discharged out of the oil tank and cleaned so that a soldering process can be employed to seal the crevice. Maintaining this oil tank is a hard and expensive task.

Further, when directly building an oil tank under the ground, the cost is high. In case of a leakage occurred, it is difficult to detect such a leakage, and leaked oil will permeate into the soil to pollute underground water.

SUMMARY OF THE INVENTION

The present invention has been accomplished under the circumstances in view. It is therefore the main object of the present invention to provide an underwater oil storage method, which uses water to isolate storage oil from the ground earth by means of the physical characteristic that the specific gravity of oil is lower than water. It is another object of the present invention to provide an underwater oil storage method, which automatically regulates the water level of the water that supports the oil tank, keeping the oil tank in balance. It is still another object of the present invention to provide an underwater oil storage method, which keeps the oil tank under the water in a water pool, preventing contamination of storage oil to the surrounding ground earth, and allowing quick visual inspection upon an oil leakage.

To achieve these and other objects of the present invention, the underwater oil storage method includes the steps of a) excavating a cellar in the ground earth and constructing a wall structure in the cellar to form a water pool; b) setting an oil tank having a predetermined shape and volume in the water pool; c) supplying a predetermined amount of water to the water pool; and d) filling the oil to be stored into the oil tank and regulating the amount of water in the water pool subject to the amount of storage oil stored in the oil tank where the oil to be stored has a specific gravity lower than the water filled in the water pool, and the amount of the storage oil filled into the oil tank is less than the volume of the oil tank.

DETAILED DESCRIPTION OF THE PREFERRED EMBODIMENT

Figure 1:
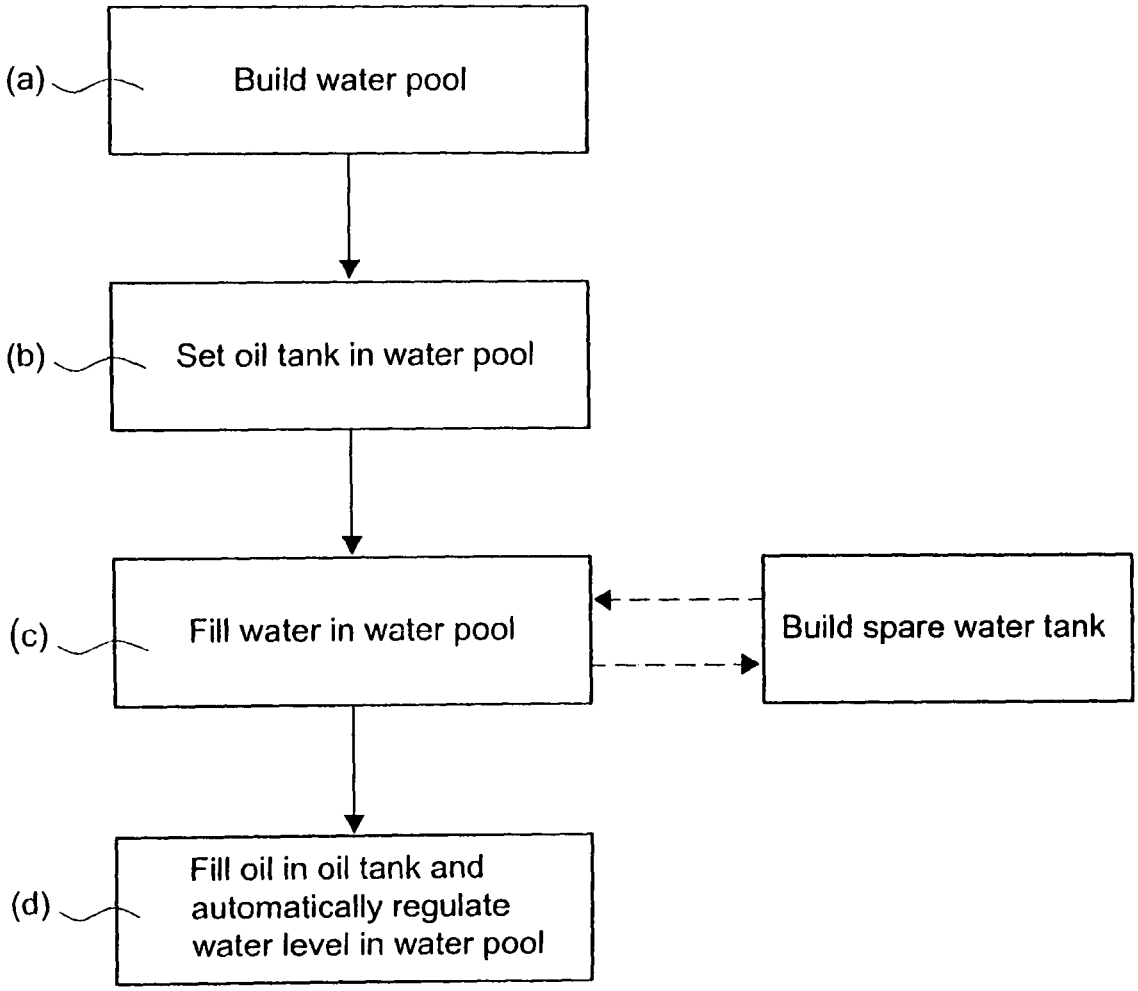
FIG. 1 is a flow chart of an underwater oil storage method according to the present invention.
Figure 2A:
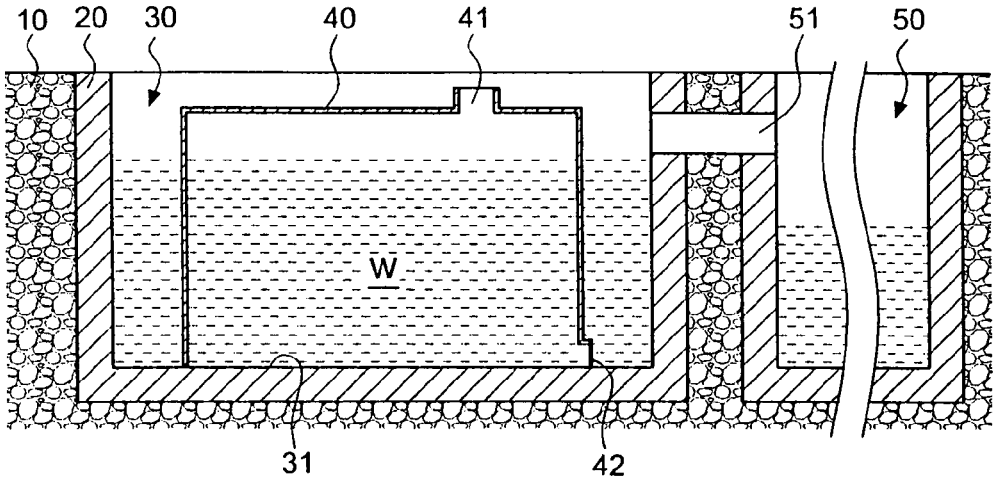
FIGS. 2A~2F illustrate the construction and operation of an underwater oil storage system according to a first embodiment of the present invention.

Referring to FIGS. 1 and 2A, an underwater oil storage method in accordance with the present invention includes the steps of:

a) excavating a cellar in the ground earth 10 and constructing a wall structure 20 in the cellar to form a water pool 30, where the wall structure 20 is a continuous concrete wall set in the horizontal bottom and upright peripheral sides of the cavity formed in the ground earth 10 for protection and isolation;

b) setting an oil tank 40 in the water pool 30 and directly supporting the oil tank 40 on the bottom wall 31 of the water pool 30, where the oil tank 40 can be a metal, concrete or plastic container or a container made of any of variety of oil-proof materials subject to a predetermined size and has an oil access port 41 at the top side thereof and at least one bottom port 42 at the bottom side thereof in communication with the inside space of the water pool 30 for allowing water to flow through the bottom port 42 between the water pool 30 and oil tank 40;

c) supplying a predetermined amount of water W to the water pool 30, where water W can be city water, sea water, industrial waste water that is kept in the water pool 30 by the wall structure 20; said predetermined amount means that an auto fluid supplying and adjusting mechanism is provided to control the amount of water W in the water pool 30 subject to the type of oil tank 40 and the volume of oil stored in oil tank 40; and d) filling oil O into oil tank 40 through oil access port 41, where oil O can be raw petroleum, gasoline, mineral oil, animal oil, vegetable oil, or any of a variety of chemical fluids of specific gravity smaller than 1; the filling amount of oil O is less than the volume of oil tank 40 so that oil O filled in oil tank 40 does not flow out of oil tank 40 into the water pool 30 and then float on water W in the water pool 30 outside the tank 40.

Figure 2B:
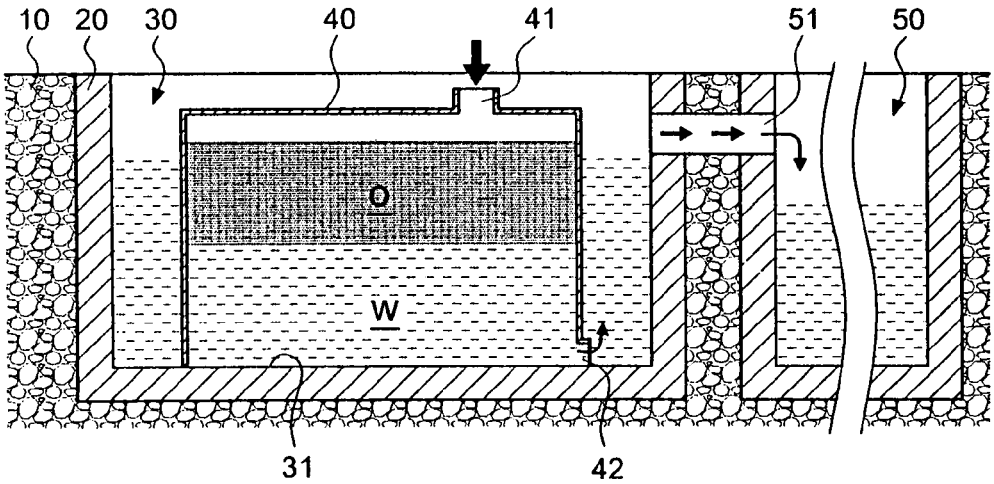
Figure 2C:
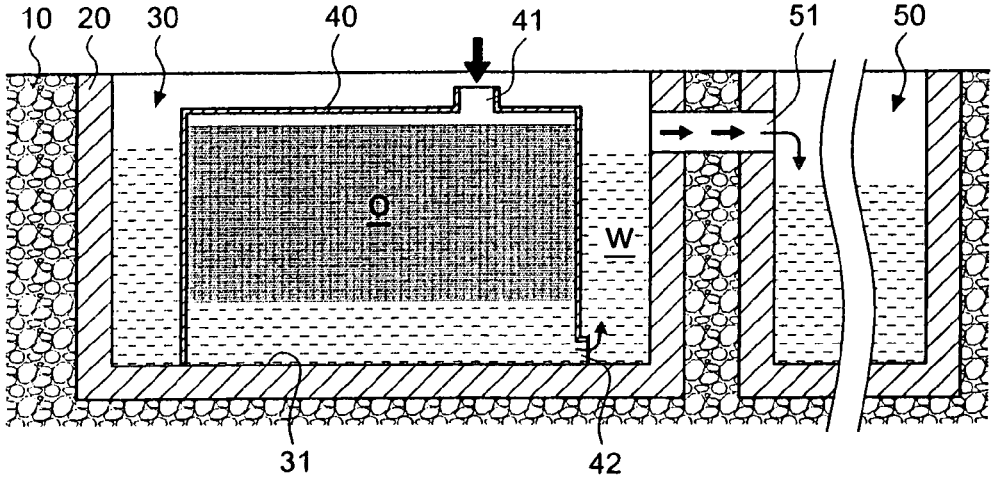

Referring to FIGS. 2B and 2C, because the specific gravity of oil O (normally about 0.9) is smaller than the specific gravity (1) of water W, oil O will float on water W in oil tank 40 when filling oil O into oil tank 40 through oil access port 41, and water W will be gradually forced out of oil tank 40 into the water pool 30 subject to the increasing of the filling amount of oil O. Because the volume of the water pool 30 is constant, filling oil O into oil tank 40 causes increasing of the water level in the water pool 30. The invention further provides a spare water tank 50 at one side of the water pool 30 on the same level. A connecting pipe 51 is horizontally provided between the water pool 30 and the spare water tank 50 near the top side. When the water lever in the water pool 30 surpassed a predetermined high level, water W flows out of the water pool 30 into the water tank 50 through the connecting pipe 51 for further use.

Figure 2D:
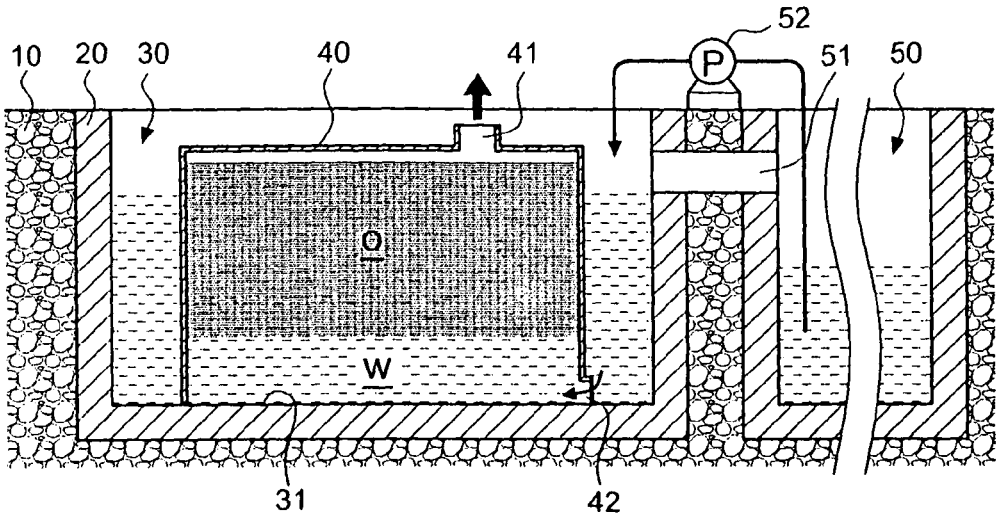
Figure 2E:
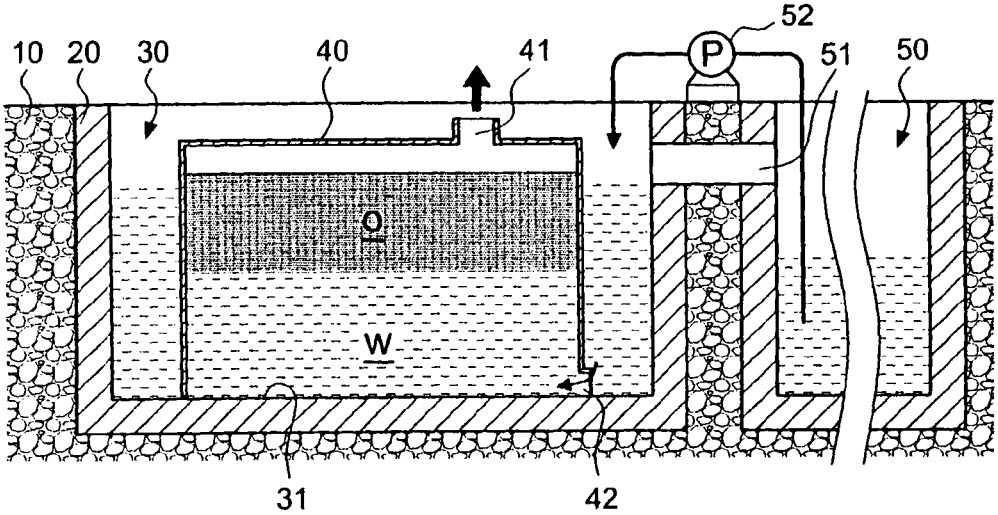
Figure 2F:
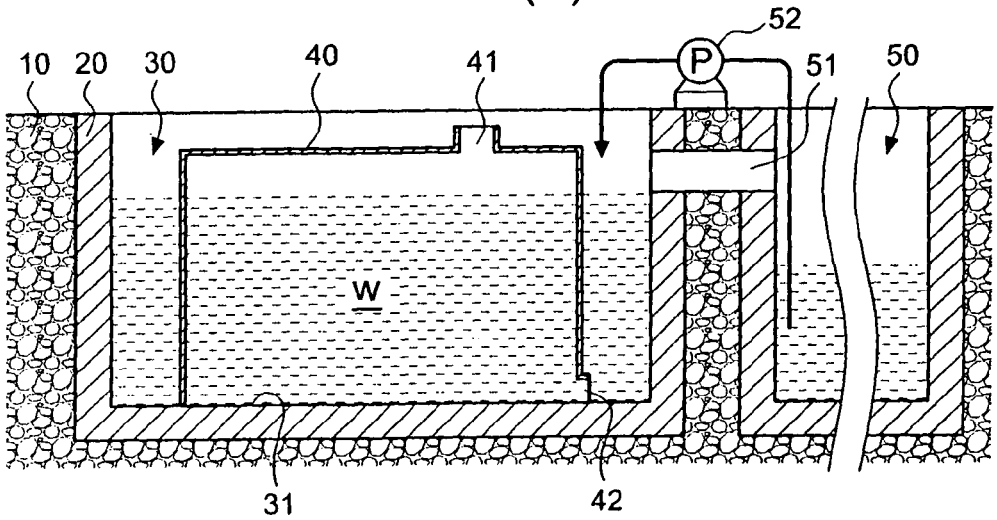
Figure 3A:
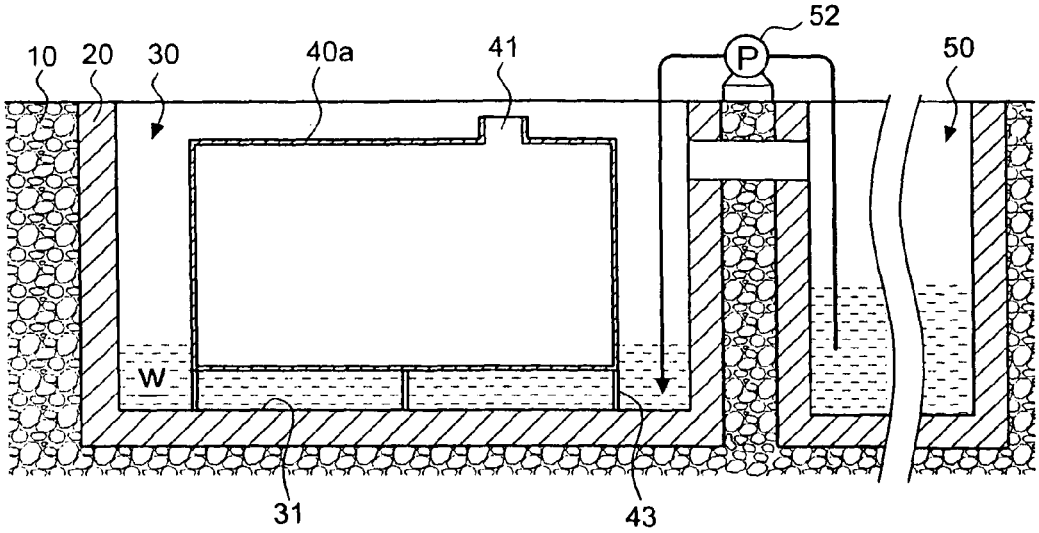
FIGS. 3A~3F illustrate the construction and operation of an underwater oil storage system according to a second embodiment of the present invention.
Figure 3B:
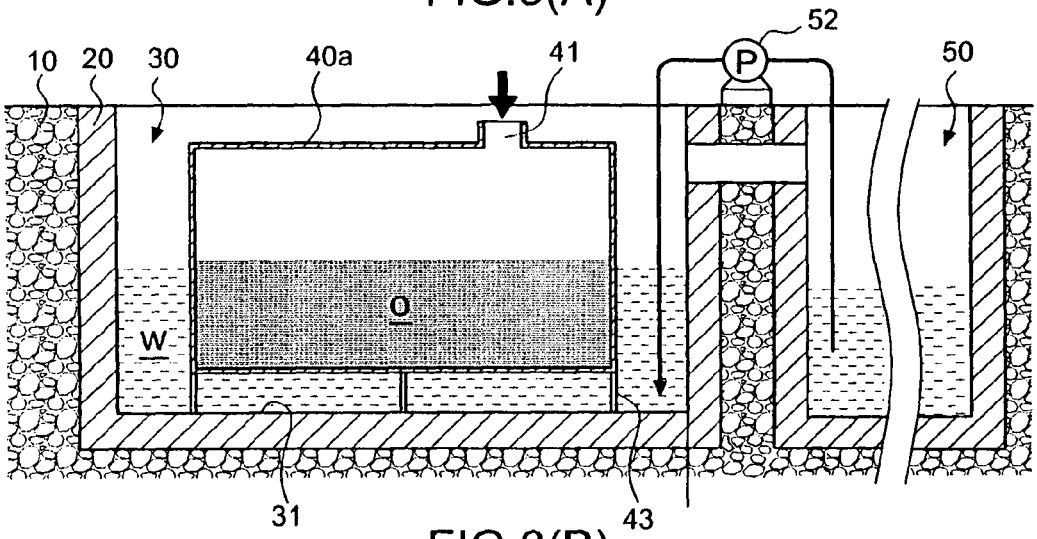
Figure 3C:
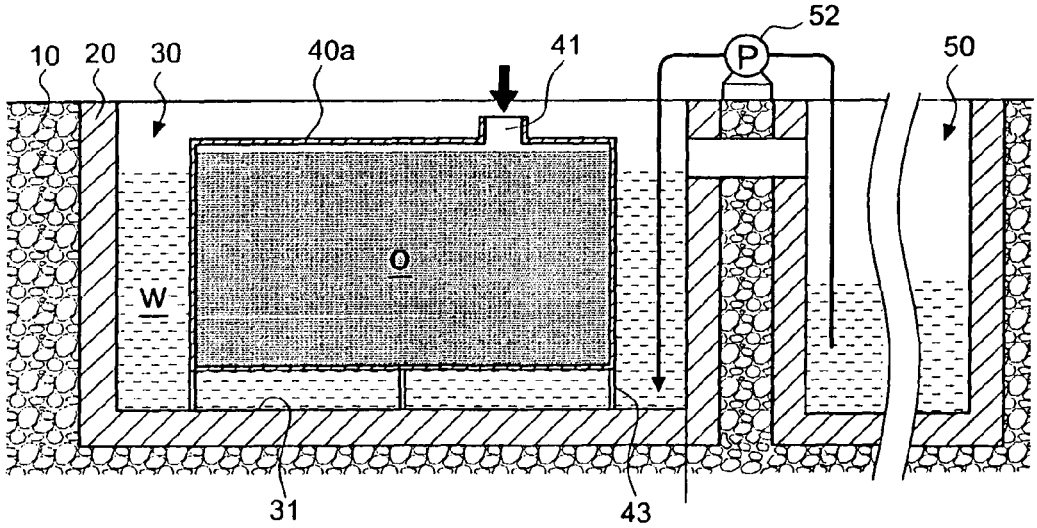
Figure 3D:
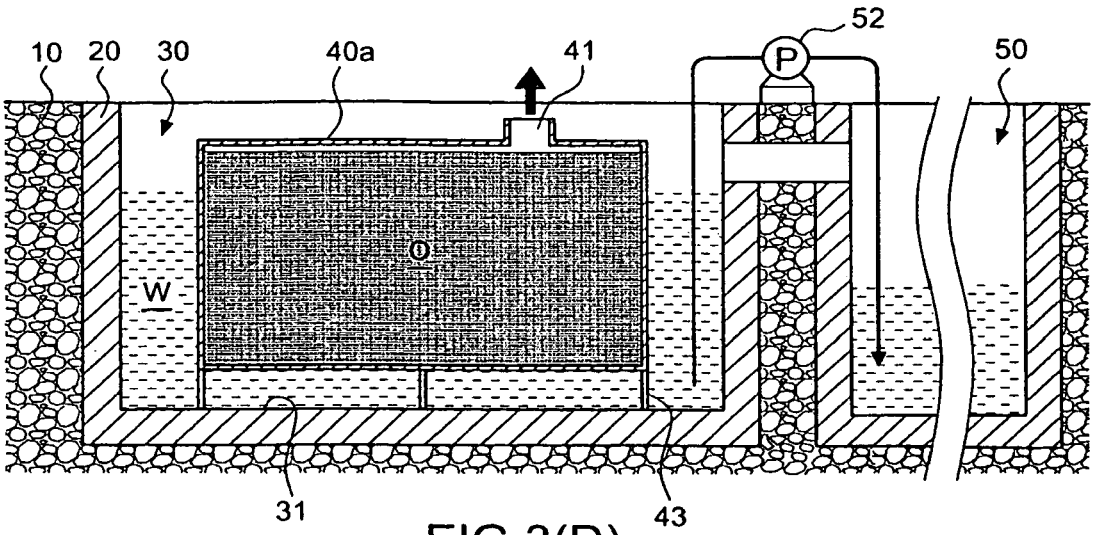
Figure 3E:
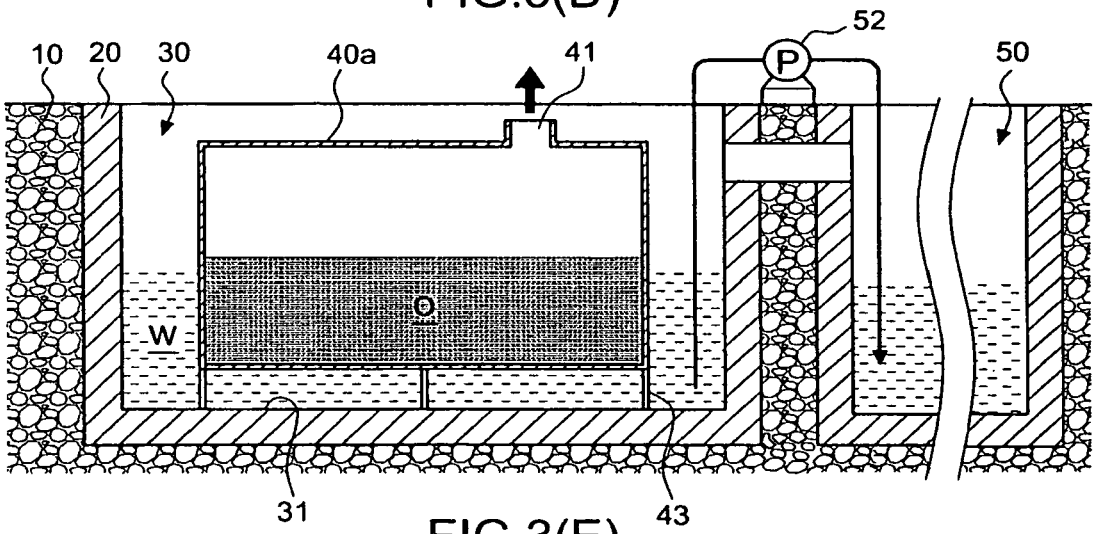
Figure 3F:
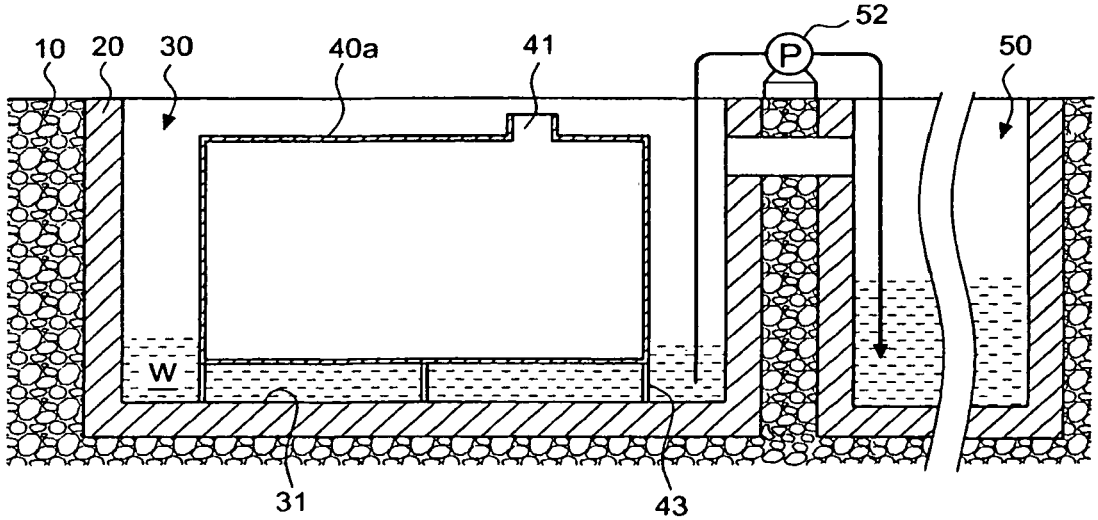

Referring to FIGS. 2D~2F, when pumping oil O out of oil tank 40 through oil access port 41 for use, the amount of oil O is oil tank 40 is gradually reducing, the water level of water W in oil tank 40 is gradually increasing to lift oil O in the water tank 40, and the water level of water W in the water pool 30 outside oil tank 40 is gradually lowering. At this time, the spared water can be guided from the water tank 50 into the water pool 30. According to this embodiment, an auto water control system 52 which is formed of a water pump and a water level sensor is provided for detecting the water level of water W in the water pool 30 and automatically pumping water W out of the water tank 50 into the water pool 30 when the water level of water W in the water pool 30 dropped below a predetermined range. Therefore, the amount of water W in the water pool 3 and oil tank 40 is automatically adjusted subject to the amount of oil O in oil tank 40, enabling water W to support the gravity weight of oil tank 40 and to keep oil tank 40 in balance.

As indicated above, the invention uses water W in the water pool 30 to isolate oil O from the ground earth and to support the gravity weight of the oil tank 40 and oil O contained in the oil tank 40 and to keep the oil tank 40 in balance by means of the physical characteristic that the specific gravity of oil O is smaller than water W.

In an application example of the present invention, the oil tank 40 in the water pool 30 has the depth of 24 meters. When the water tank 40 is filled up with oil O of specific gravity 0.9, the oil level of oil O in the oil tank 40 is 2.4 meters above the water level of water W in the water pool 30. At this time, water W supports and sets off 90% of the pressure, and the oil tank 40 bears only the other 10% of the pressure. Therefore, when designing the material strength of the material for the oil tank 40, it needs only to consider the pressure of oil O of depth 2.4 meters but not the pressure of oil O of depth 24 meters. When storing oil O of specific gravity 0.99, water W in the water pool 30 supports and sets off 99% of the pressure, and the water tank 40 bears only 1% of the pressure. Therefore, the invention breaks the conventional concept of constructing an oil tank with thick steel plate members. When constructing an oil tank of volume 130,000 square meters (Height 24M× Diameter 86M), it needs only to build up a concrete wall structure of Height 24M×Length 76M×Width 76M (saving about 10M×10M ground area). By means of binding reinforcing steel wire rods, setting molding forms, pouring concrete, and removing molding forms after setting of concrete, the desired wall structure 20 is built up, and the designed oil tank 40 can then be set in the water pool 30 thus formed. Further, using plastic or stainless steel plate members to construct the wall structure 20 instead of concrete accelerates the construction speed.

Because the oil tank 40 is set in the water pool 30 under the ground, it is not necessary to build up an additional retaining wall to protect the oil tank 40 against earthquake or any human beings' destruction behavior. Because the oil tank 40 is set under the ground, it is safe against human beings' destruction behavior, and storage oil O is free from the effect of the surrounding weather. Further, no lightning arrester or the like is necessary. In case of an earthquake, water W in the water pool 30 absorbs shock waves. Because the oil tank 40 bears a small pressure, the manufacturing cost of the oil tank 40 can be greatly reduced.

FIGS. 3A~3F show an alternate form of the present invention. According to this embodiment, the oil tank, referenced by 40*a* has an oil access port 41 at the top side, however the oil tank 40*a* has no port at its bottom side. Further, racks 43 are fixedly provided at the bottom wall of the oil tank 40*a* and supported on the top side of the bottom wall 31 of the water pool 30, allowing water to flow through the bottom side of the oil tank 40*a*, however storage oil O is prohibited from passing out of the oil tank 40*a* into water W in the water pool 30. When filling storage oil O into the oil tank 40*a*, water W is simultaneously filled into the water pool 30 by means of the control of the auto water control system 52, and therefore the water level of water W in the water pool 30 and the oil level of oil O in the oil tank 40 are synchronously raised (see FIGS. 3A~3C). On the contrary, when pumping oil O out of the oil tank 40*a* for use, the auto water control system 52 automatically pumps water W out of the water pool 30 into the water tank 50, keeping the water pressure of water W in the water pool 30 in balance with the pressure of the oil tank 40*a* (see FIGS. 3D~3F).

Figure 4:
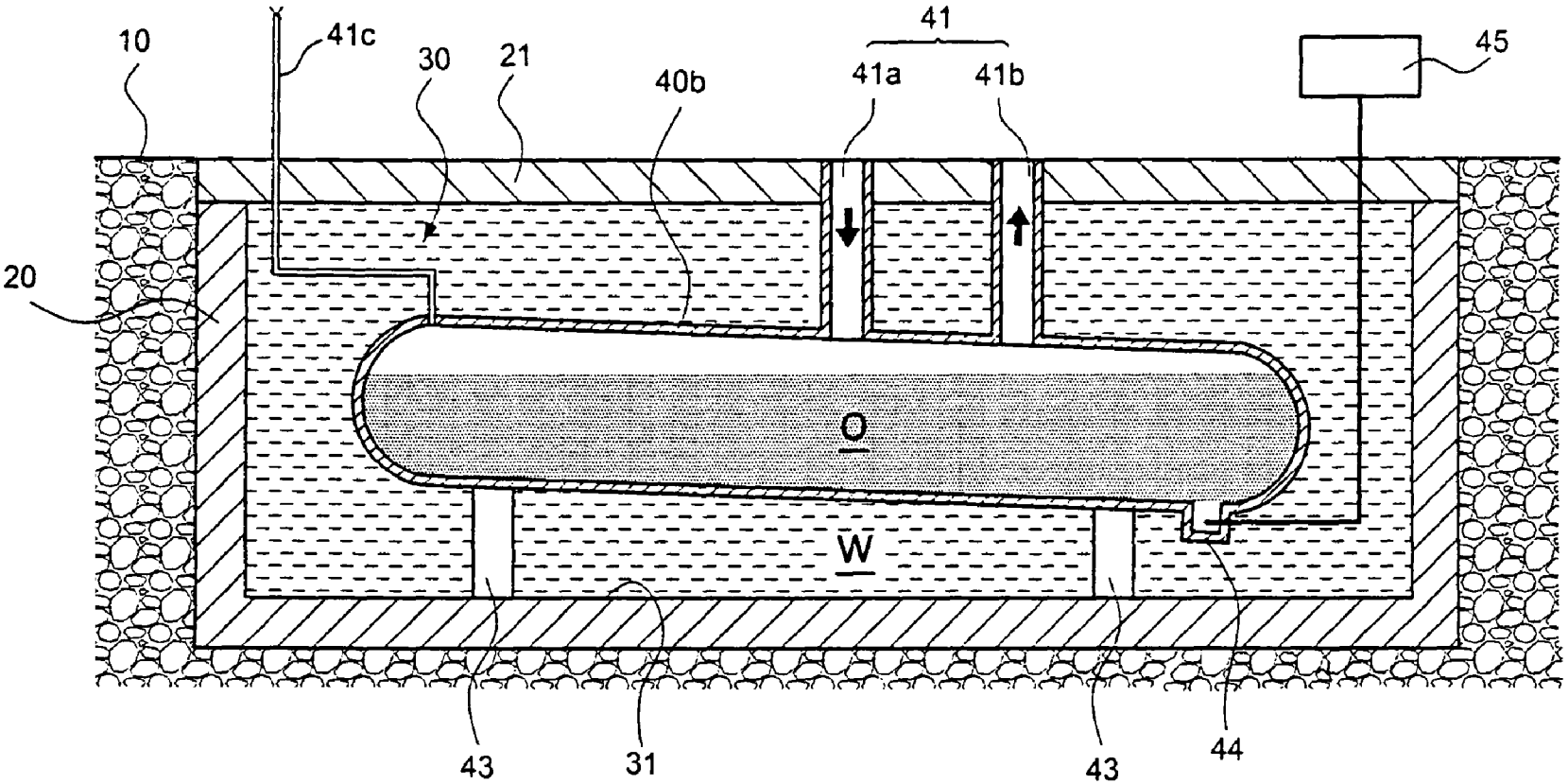
FIG. 4 is a schematic sectional view of an underwater oil storage system according to a third embodiment of the present invention.

In additional to the aforesaid big scale design, the invention is also applicable for a relatively smaller scale design for use in, for example, a gas station. According to the third embodiment of the present invention shown in FIG. 4, a top cover 21 is covered on the wall structure 20 to close the water pool 30; the oil tank 40*b* is fixedly supported on a rack 43' (or racks 43') above the bottom wall 31 of the water pool 30 against floating of water W in the water pool 30, having an oil access port 41, which is comprised of an oil inlet pipe 41*a* and an oil outlet pipe 41*b* that are respectively upwardly extending from the top side of the oil tank 40*b* to the outside of the top cover 21, and an air pipe 41*c* equipped with a relief valve (not shown) and upwardly extending to the outside of the water pool 30 for discharging of air when the air pressure in the oil tank 40*b* surpassed a predetermined level. The functioning of this embodiment is substantially similar to the aforesaid second embodiment with the exception that the water lever of water W in the water pool 30 surpasses the elevation of the top side of the oil tank 40*b*, i.e., the oil tank 40*b* is constantly kept under water W.

Preferably, the oil tank 40*b* is mounted on the rack 43' in a tilt angle, having a recessed water reservoir portion 44 at the lowest area on the inside and connected to an external water sensor 45 by a connecting line. In case water W leaks in the oil tank 40*b*, leak-in water will be accumulated in the recessed water reservoir portion 44 and detected by the water sensor 45, and a repair work can be quickly employed to prevent a further damage. In case the positive pressure type oil tank 40*b* has a damage and oil O leaks out of the oil tank 40*b*, leaked oil O will float on water W, and the worker in the gas station can easily find the problem and take the necessary measure to eliminate the problem. Same as the aforesaid various embodiments of the present invention, this embodiment uses water W to isolate storage oil O from the ground soil, preventing pollution to the surrounding earth. Further, water W is used in the water pool 30 to support the oil tank 40*b* and the pressure of the storage oil O in the oil tank 40*b*.

In general, the invention provides an underwater oil storage system, which uses water to support an oil tank and storage oil in the oil tank and to keep the oil tank in balance, presenting contact of storage oil with the ground earth.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An underwater oil storage method comprising the steps of:

a) excavating a cellar in the ground earth and constructing a wall structure in said cellar to form a water pool;

b) setting an oil tank having a predetermined shape and volume in said water pool;

c) fixedly securing said oil tank within said water pool;

d) supplying a predetermined amount of water in said water pool;

e) filling the oil to be stored into said oil tank; and f) regulating the amount of water in said water pool responsive to the amount of storage oil stored in said oil tank where the oil to be stored has a specific gravity lower than the water filled in said water pool, and the amount of the storage oil filled into said oil tank is less than the volume of said oil tank;

wherein regulating the amount of water in said water pool is achieved by an auto water control system, said auto water control system includes simultaneously filling said water pool with water and filling said oil tank with oil; whereby when filling oil the level of water in said water pool and the level of oil in said oil tank are raised synchronously using said auto water control system; wherein when pumping oil out of the oil tank for use, the auto water control system automatically pumping water out of the water pool, thereby keeping the water pressure of water in said water pool in balance with the pressure of said oil tank.

2. The underwater oil storage method as claimed in claim 1, wherein the step of fixedly securing said oil tank within said water pool further comprises of a rack being provided between a bottom wall of said oil tank and a top side of a bottom wall of said water pool for fixedly supporting said oil tank.

3. The underwater oil storage method as claimed in claim 1, further comprising the step of building a spare water tank under the ground earth at one side of said water pool and connecting a water pipe between said water pool and said spare water tank for providing fluid communication therebetween;

wherein said auto water control system comprises a water pump and a water level sensor for detecting the level of water in said water pool.

4. An underwater oil tank storage system comprising:

a water pool defined by a wall construction under the ground earth to hold a quantity of water;

an oil tank fixedly set in said water pool and at least partially surrounded by water held in said water pool to hold oil having a specific gravity lower than the water held in said water pool;

a spare water tank in open fluid communication with said water pool; and a control system and pump connected between said spare water tank and said water pool for simultaneously and synchronously adjusting a level of water held in said water pool responsive to a change in a level of oil in said oil tank to maintain water pressure external to said oil tank in balance with pressure internal to said oil tank;

whereby when filling oil the level of water in said water pool and the level of oil in said oil tank are raised synchronously using said control system and pump; wherein when pumping oil out of the oil tank for use, the control system and pump automatically pumping water out of the water pool, thereby keeping the water pressure of water in said water pool in balance with the pressure of said oil tank.

5. The underwater oil tank storage system as claimed in claim 4, wherein said spare water tank is located adjacent a side of said water pool.

6. The underwater oil tank storage system as claimed in claim 4, further comprising of a rack being provided between a bottom wall of said oil tank and a top side of a bottom wall of said water pool for fixedly supporting said oil tank.

* * * * *